US009284741B2

(12) United States Patent
Scheps et al.

(10) Patent No.: US 9,284,741 B2
(45) Date of Patent: Mar. 15, 2016

(54) COVER APPARATUS INCLUDING A COVER ASSEMBLY AND AT LEAST ONE DRIVE MECHANISM

(71) Applicant: Palladium Product Development & Design Inc., Richmond Hill (CA)

(72) Inventors: Richard Anthony Scheps, Sharon (CA); Alan Gaensbauer, Toronto (CA); Robert Rotenberg, Aurora (CA)

(73) Assignee: PALLADIUM PRODUCT DEVELOPMENT & DESIGN INC., Richmond Hill (CA)

( * ) Notice: Subject to any disclaimer, the term of this patent is extended or adjusted under 35 U.S.C. 154(b) by 257 days.

(21) Appl. No.: 13/832,637

(22) Filed: Mar. 15, 2013

(65) Prior Publication Data

US 2014/0000021 A1 Jan. 2, 2014

Related U.S. Application Data

(60) Provisional application No. 61/666,033, filed on Jun. 29, 2012.

(51) Int. Cl.
*E04H 4/00* (2006.01)
*E04H 4/10* (2006.01)

(52) U.S. Cl.
CPC ..... *E04H 4/101* (2013.01)

(58) Field of Classification Search
CPC ..... E04H 4/101; E04H 4/10; E04H 4/108
USPC ..... 4/498–503
See application file for complete search history.

(56) References Cited

U.S. PATENT DOCUMENTS

| | | | |
|---|---|---|---|
| 4,324,370 | A | 4/1982 | Guard et al. |
| 4,858,253 | A | 8/1989 | Lamb |
| 5,184,356 | A | 2/1993 | Lof et al. |
| 5,524,302 | A | 6/1996 | Ragsdale et al. |
| 6,014,778 | A | 1/2000 | Varnado |
| 6,026,522 | A | 2/2000 | Last |

(Continued)

FOREIGN PATENT DOCUMENTS

| | | | |
|---|---|---|---|
| EP | 2201869 | A1 | 6/2010 |
| FR | 2867498 | A1 | 9/2005 |

(Continued)

OTHER PUBLICATIONS

International Search Report and Written Opinion issued Nov. 15, 2013 in respect of International Application No. PCT/CA2013/050506.

*Primary Examiner* — Huyen Le
*Assistant Examiner* — Christine Skubinna
(74) *Attorney, Agent, or Firm* — Bereskin & Parr LLP/S.E.N.C.R.L., s.r.l.

(57) ABSTRACT

A cover apparatus includes a frame, a cover assembly at least partially supported by the frame, and a drive mechanism. The cover assembly includes a generally planar main portion, and at least one edge portion adjoining a side edge of the main portion. The drive mechanism engages the edge portion and moves the cover assembly relative to the frame to advance or retract the cover assembly. The drive mechanism may include first engagement elements, and the edge portion may include second engagement elements that interengage with the first engagement elements. The cover apparatus may be used for covering a pool.

23 Claims, 12 Drawing Sheets

(56) References Cited

U.S. PATENT DOCUMENTS

| | | | | |
|---|---|---|---|---|
| 6,618,869 | B1 | 9/2003 | Jacobs | |
| 6,871,362 | B1 | 3/2005 | Zell | |
| 7,493,933 | B2 * | 2/2009 | Li | 160/370.22 |
| 2004/0117904 | A1 * | 6/2004 | Ragsdale et al. | 4/502 |
| 2007/0079434 | A1 * | 4/2007 | Pellerin | 4/498 |
| 2010/0170032 | A1 * | 7/2010 | Sproatt et al. | 4/502 |

FOREIGN PATENT DOCUMENTS

| | | | |
|---|---|---|---|
| JP | 06108763 | A | 4/1994 |
| WO | 2005118983 | A1 | 12/2005 |

* cited by examiner

COVER APPARATUS INCLUDING A COVER ASSEMBLY AND AT LEAST ONE DRIVE MECHANISM

CROSS-REFERENCE TO RELATED APPLICATION

This application claims priority to U.S. Provisional Application No. 61/666,033 filed on Jun. 29, 2012, the entire contents of which are hereby incorporated herein by reference.

FIELD

The present disclosure relates generally to covers that are driven between advanced and retracted positions. The present disclosure also relates to pool covers.

BACKGROUND

The following paragraphs are not an admission that anything discussed in them is prior art or part of the knowledge of persons skilled in the art.

U.S. Pat. No. 6,026,522 describes a manually powered swimming pool cover drive for extending and retracting swimming pool covers and which includes a pair of overrunning one way clutch devices for intermittent coupled rotation with and also freewheeling about a drive shaft. A drum rotates with the drive shaft and allows winding of a cover about the drum when retracted from a covered position over a swimming pool. A pair of one way clutches may be trained around a drive shaft and coupled for rotating a cable reel allowing for the winding of cables used to extend a swimming pool cover. The respective pairs of overrunning, one-way clutches are reciprocated back and forth respectively in a type of indexing operation, manually and with long lever handles for rotating the drive shafts.

U.S. Pat. No. 6,618,869 describes an apparatus for rolling up and laying out a solar pool cover over a pool. The apparatus comprises two support frames, two reel supports, and a reel shaft that is mounted atop the two support frames. The two support frames are located opposite one another across the width of the pool. The solar pool cover is wound around the reel shaft. The reel shaft is hooked up to a motor which is atop one of the support frames.

U.S. Pat. No. 6,871,362 describes a pair of end heads that are interconnected onto the inwardly disposed tube assembly to form the pool cover storage reel. Hand wheels are rotationally attached to tube assembly by end tubes on the outside of the end heads. Each of the end heads includes a pair of casters mounted to the bottom surface of the end head. The tube assembly consists of five components, a center tube, two outer tubes and two end caps. The center tube is of larger diameter and allows for the two outer tubes to be telescopically inserted into the opposing distal ends. The cylindrically shaped tubes include mating male and female extrusions along the surfaces to ensure joint rotational movement of the tube assembly. The telescoping tubes include a series of holes along the surface creating cavities and providing convenient and efficient means to store the straps, springs or other anchoring means that are positioned around the perimeter of the covering.

INTRODUCTION

The following paragraphs are intended to introduce the reader to the more detailed description that follows and not to define or limit the claimed subject matter.

According to an aspect of the present disclosure, a cover apparatus may include: a frame; a cover assembly at least partially supported by the frame, the cover assembly including a generally planar main portion having at least one side edge, and at least one edge portion adjoining the at least one side edge of the main portion; and a drive mechanism coupled to the frame, the drive mechanism configured to engage the at least one edge portion and move the cover assembly relative to the frame to advance or retract the cover assembly.

According to an aspect of the present disclosure, a cover apparatus may include: a frame; a cover assembly at least partially supported by the frame, the cover assembly including a generally planar main portion having a side edge, and an edge portion adjoining the side edge of the main portion, the edge portion including a plurality of apertures spaced apart along a length of the edge portion, and an enlarged outer lip extending along the length; and a drive mechanism coupled to the frame, the drive mechanism including a feed wheel including a plurality of protrusions spaced apart about an outer circumference of the feed wheel, and at least one guide element, wherein the apertures receive the protrusions, so that the feed wheel engages the edge portion, and rotation of the feed wheel causes the cover assembly to move relative to the frame, and wherein the at least one guide element slidingly receives the outer lip of the edge portion, so that lateral movement of the outer lip is restricted, and the outer lip is guided by the drive mechanism when the cover assembly is advanced out of the drive mechanism.

According to an aspect of the present disclosure, a pool cover apparatus may include: a frame; a cover assembly at least partially supported by the frame, the cover assembly including a generally planar main portion having first and second side edges, and respective first and second edge portions adjoining the first and second side edges of the main portion; and first and second drive mechanisms coupled to the frame, the first and second drive mechanisms configured to respectively engage the first and second edge portions and move the cover assembly relative to the frame to advance or retract the cover assembly.

BRIEF DESCRIPTION OF THE DRAWINGS

The drawings included herewith are for illustrating various examples of apparatuses and methods of the present disclosure and are not intended to limit the scope of what is taught in any way. In the drawings.

DETAILED DESCRIPTION

Various apparatuses or methods are described below to provide an example of an embodiment of each claimed invention. No embodiment described below limits any claimed invention and any claimed invention may cover apparatuses and methods that differ from those described below. The claimed inventions are not limited to apparatuses and methods having all of the features of any one apparatus or method described below or to features common to multiple or all of the apparatuses or methods described below. It is possible that an apparatus or method described below is not an embodiment of any claimed invention. Any invention disclosed in an apparatus or method described below that is not claimed in this document may be the subject matter of another protective instrument, for example, a continuing patent application, and the applicant(s), inventor(s) and/or owner(s) do not intend to abandon, disclaim or dedicate to the public any such invention by its disclosure in this document.

Figure 1:
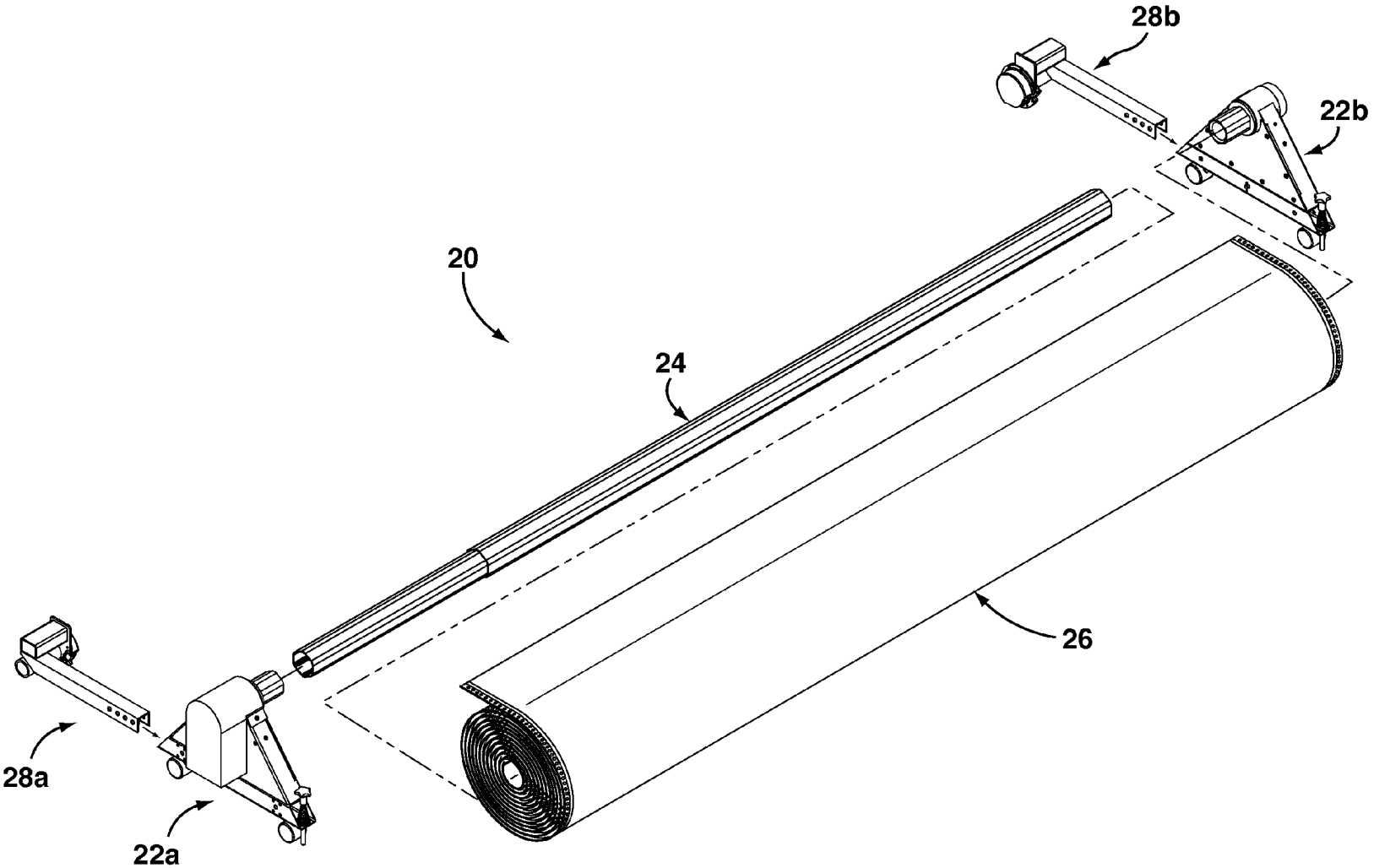
FIGS. 1 and 2 are perspective views of a cover apparatus, shown in exploded and assembled states, respectively.
Figure 2:
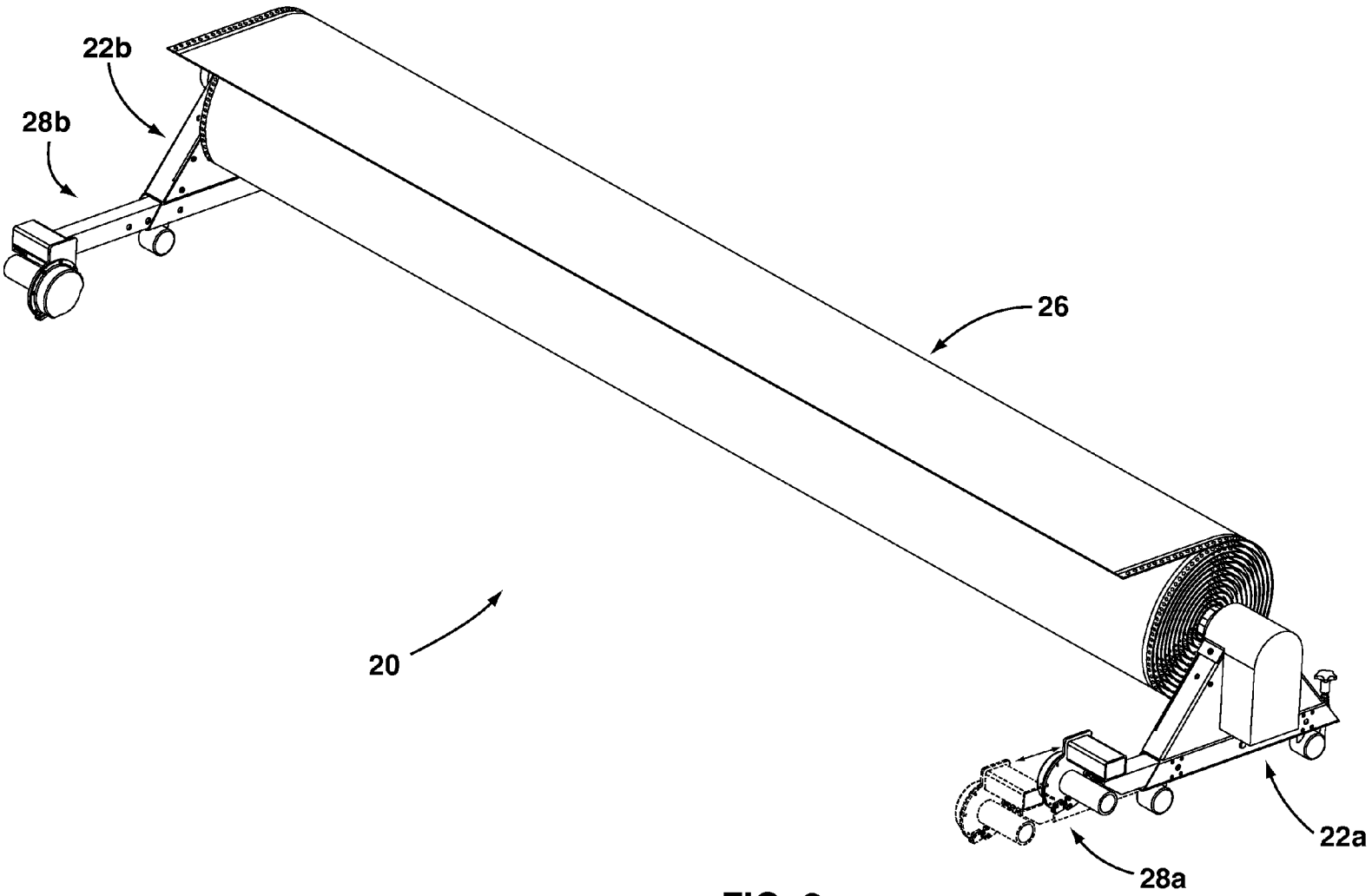

Referring to FIGS. 1 and 2, an example of a cover apparatus is shown generally at 20. The cover apparatus 20 includes a frame, which in the example illustrated includes a left side frame 22*a* and a right side frame 22*b*. In some examples, the frames 22*a*, 22*b* may be generally mirror images of one another, and of similar construction.

In the example illustrated, the cover apparatus 20 includes a spool 24 that is rotatably supported by the frames 22*a*, 22*b*. A cover assembly 26 is wound about the spool 24, and thus is at least partially supported by the frames 22*a*, 22*b*. Although not shown, the cover assembly 26 may be fixed to the spool 24 generally along its length. In FIG. 2, the cover assembly 26 obscures the spool 24 from view. The spool 24 may be formed of two or more telescoping elements, so that the distance between the frames 22*a*, 22*b* and width of the cover assembly 26 may be varied.

In some examples, the cover apparatus 20 may be well suited for implementation to cover a pool. However, the teaching herein should be limited to this application. For example, the cover apparatus 20 may be configurable in a generally vertical orientation so that the cover assembly 26 provides a means of covering a garage doorway. Other applications are possible.

The cover apparatus 20 includes a drive mechanism, which in the example illustrated includes a left side drive mechanism 28*a* coupled to the frame 22*a*, and a right side drive mechanism 28*b* coupled to the frame 22*b*. The drive mechanisms 28*a*, 28*b* are configured to move the cover assembly 26 relative to the frames 22*a*, 22*b* to advance or retract the cover assembly 26, as described in further detail herein. In some examples, the drive mechanisms 28*a*, 28*b* may be generally mirror images of one another, and of similar construction.

Figure 3:
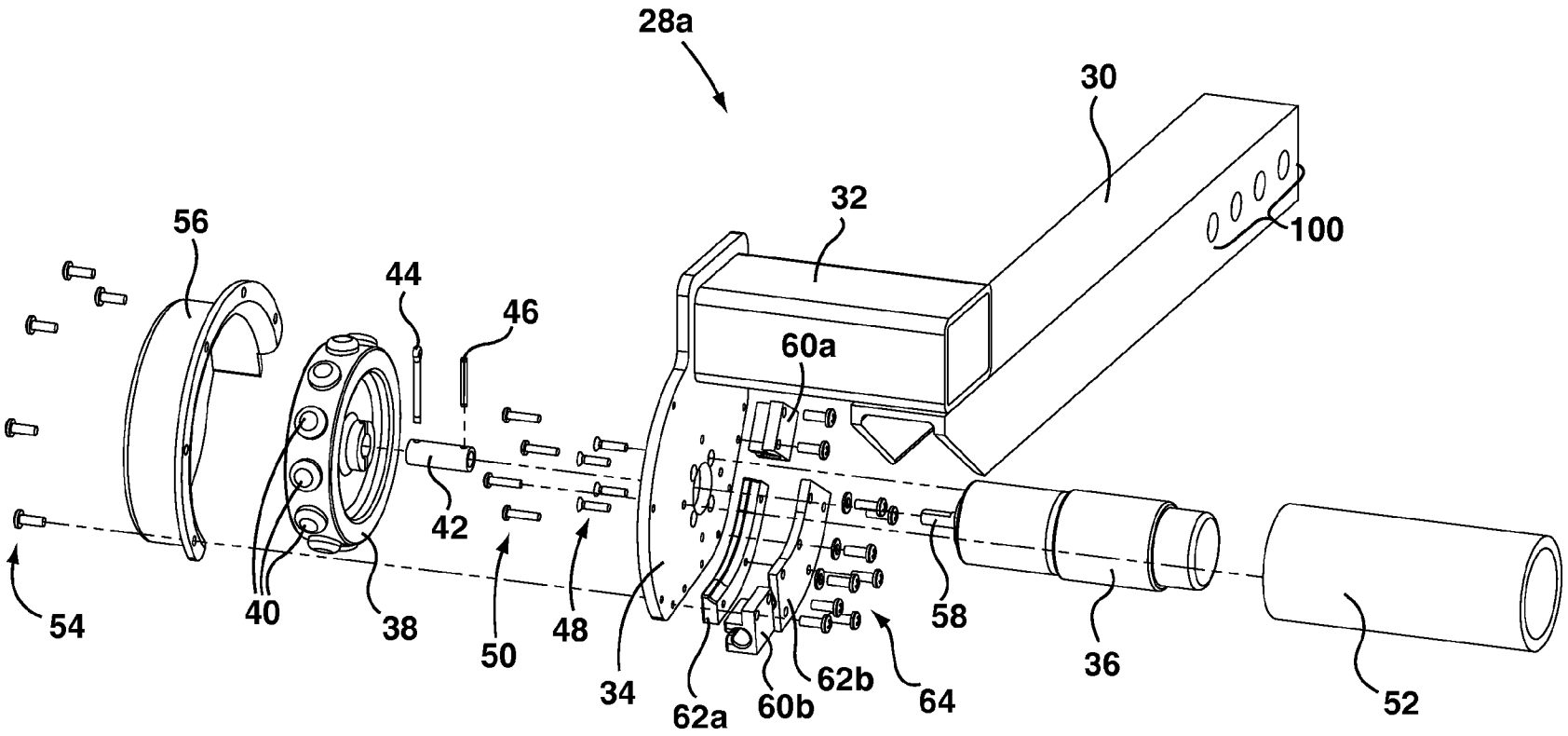
FIGS. 3 and 4 are perspective views of a drive mechanism of the cover apparatus of FIGS. 1 and 2, shown in exploded and assembled states, respectively.
Figure 4:
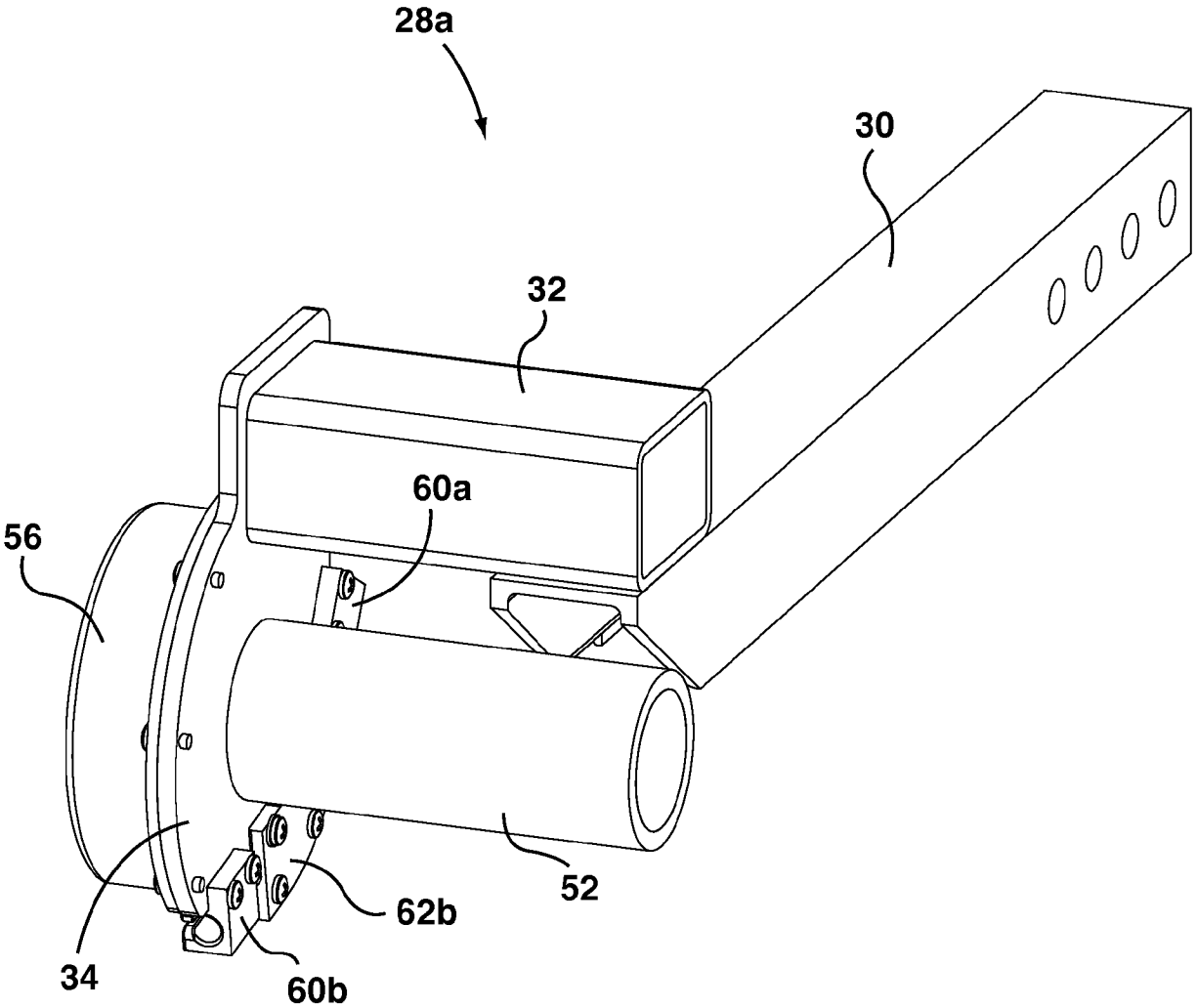

Referring now to FIGS. 3 and 4, the drive mechanism 28*a* is shown to include an arm 30, a support element 32 mounted to an end of the arm 30, and a mounting plate 34 fixed to the support element 32. A first motor 36 is coupled to the mounting plate 34. The inventors have had satisfactory results using a PK32F Series DC planetary gear motor (Hennkwell Ind. Co., Ltd., Taiwan, R.O.C.) as the first motor 36.

In the example illustrated, a feed wheel 38 includes a plurality of first engagement elements 40, which are spaced apart about an outer circumference of the feed wheel 38. A sleeve 42, a cotter pin 44 and a spring pin 46 couple the first motor 36 and the feed wheel 38 to transmit rotational power from a shaft 58 of the first motor 36 to the feed wheel 38. Fasteners 48 secure the first motor 36 to the mounting plate 34. Fasteners 50 secure a motor housing 52 to the mounting plate 34. Fasteners 54 secure a wheel guard 56 to the mounting plate 34.

In the example illustrated, the drive mechanism 28*a* includes guide elements in the form of first and second guide blocks 60*a*, 60*b*, and first and second generally opposing guide rails 62*a*, 62*b* arranged intermediate of the guide blocks 60*a*, 60*b*. Fasteners 64 secure the guide blocks 60*a*, 60*b* and the guide rails 62*a*, 62*b* to the mounting plate 34.

Figure 5:
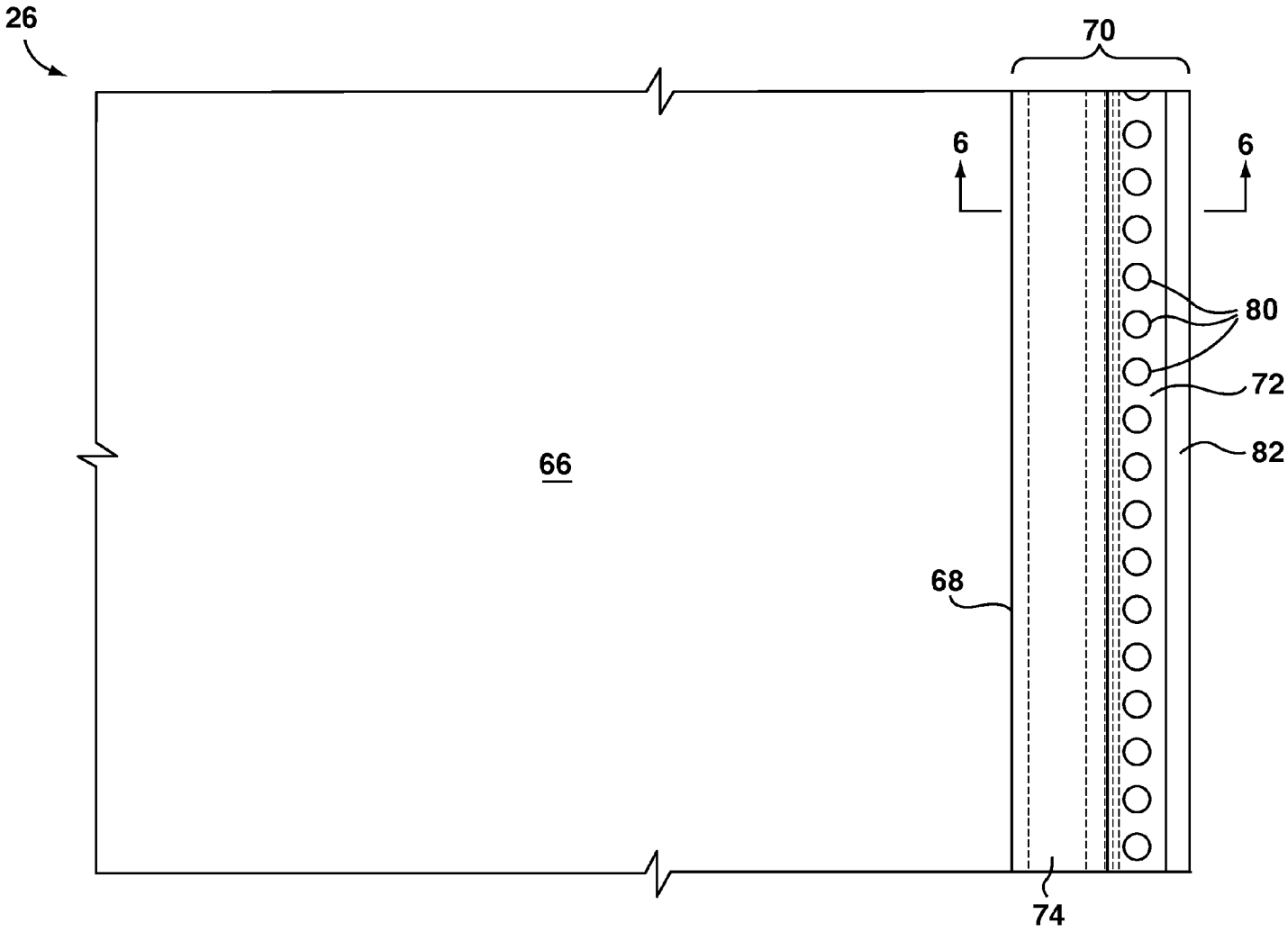
FIG. 5 shows a cover assembly of the cover apparatus of FIGS. 1 and 2.
Figure 6:
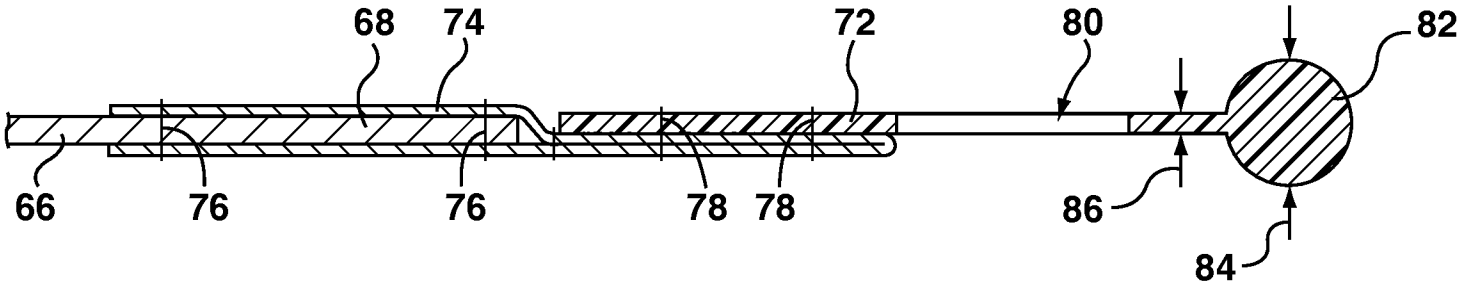
FIG. 6 is a sectional view along line 6-6 in FIG. 5.

Referring to FIGS. 5 and 6, the cover assembly 26 is shown to include a generally planar main portion 66 having at least one side edge 68. The main portion 66 may be formed of a flexible material, including, for example but not limited to, thermal bubble material or a vinyl material, for reducing heat loss and evaporation from a pool.

The cover assembly 26 includes at least one edge portion 70 that adjoins the side edge 68 of the main portion 66. The edge portion 70 may include a strip 72, which may be formed of flexible and resilient material, and may be attached along the side edge 68 of the main portion 66. In the example illustrated, the edge portion 70 includes a connection sleeve 74, which is shown sewn to the side edge 68 of the main portion 66 (i.e. along stitch lines 76), and sewn to the strip 72 (i.e. along stitch lines 78). The connection sleeve 74 may be omitted, and in various examples the edge portion 70 may be attached to the main portion 66 using stitching, rivets, adhesive, or any combination thereof.

The strip 72 includes a plurality of second engagement elements 80, which are spaced apart along a longitudinal extent of the edge portion 70. In the example illustrated, the first engagement elements 40 of the feed wheel 38 (FIG. 3) take the form of protrusions, and the second engagement elements 80 take the form of apertures that are sized and shaped to receive the engagement elements 40. The pitch of the engagement elements 80 along the longitudinal extent of the edge portion 70 is complementary to the pitch of the engagement elements 40 about the outer circumference of the feed wheel 38.

The strip 72 is shown to further include an enlarged outer lip 82 that is adjacent to the engagement elements 80. In the example illustrated, the lip 82 has a generally circular cross section, with a diameter dimension 84 that may be approximately four times a thickness dimension 86 of the strip 72. Shaping of the lip 82 is not limited to having a circular cross section and may vary.

Figure 7:
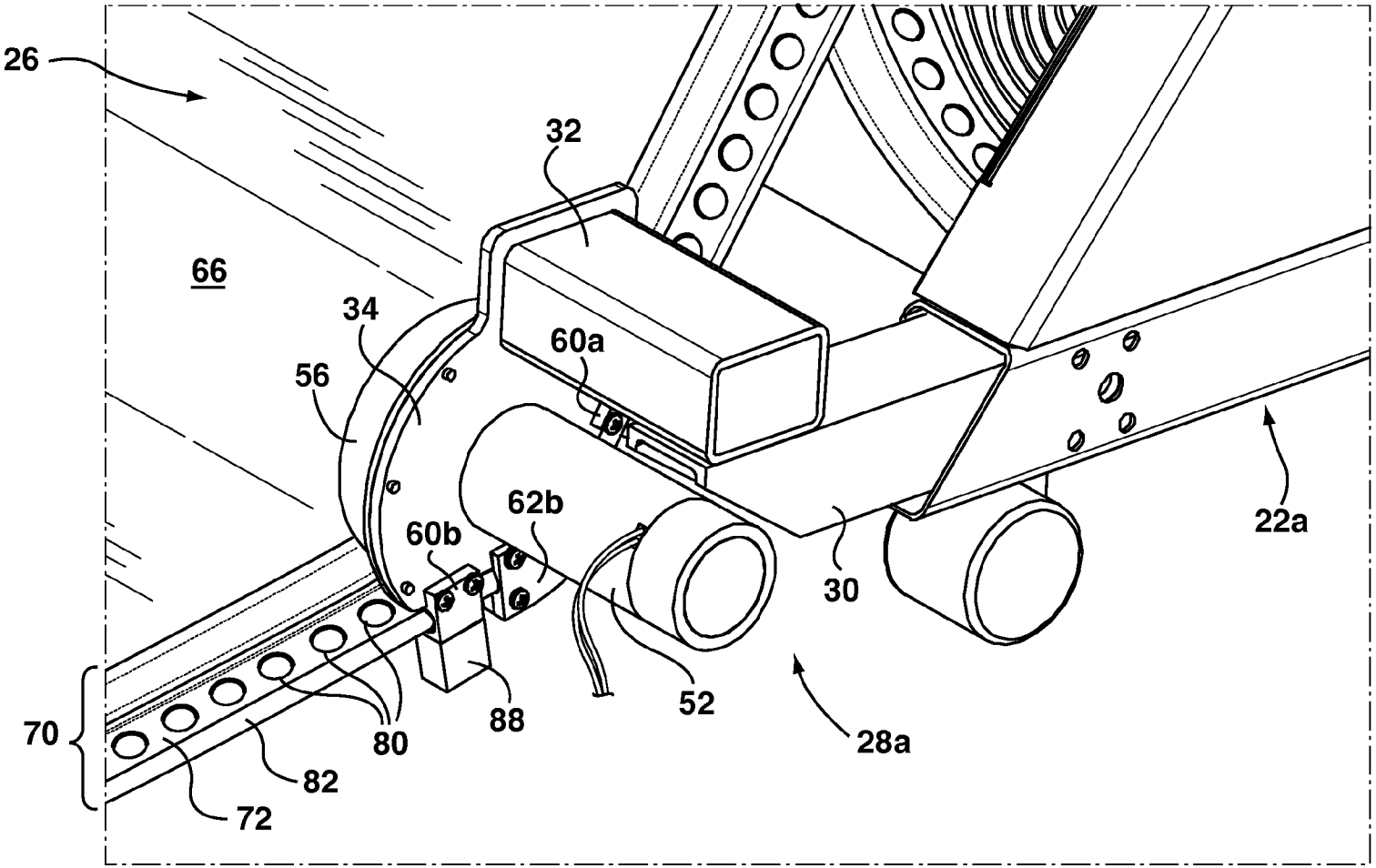
FIGS. 7 and 8 are detailed perspective views of a part of the cover apparatus of FIGS. 1 and 2.
Figure 8:
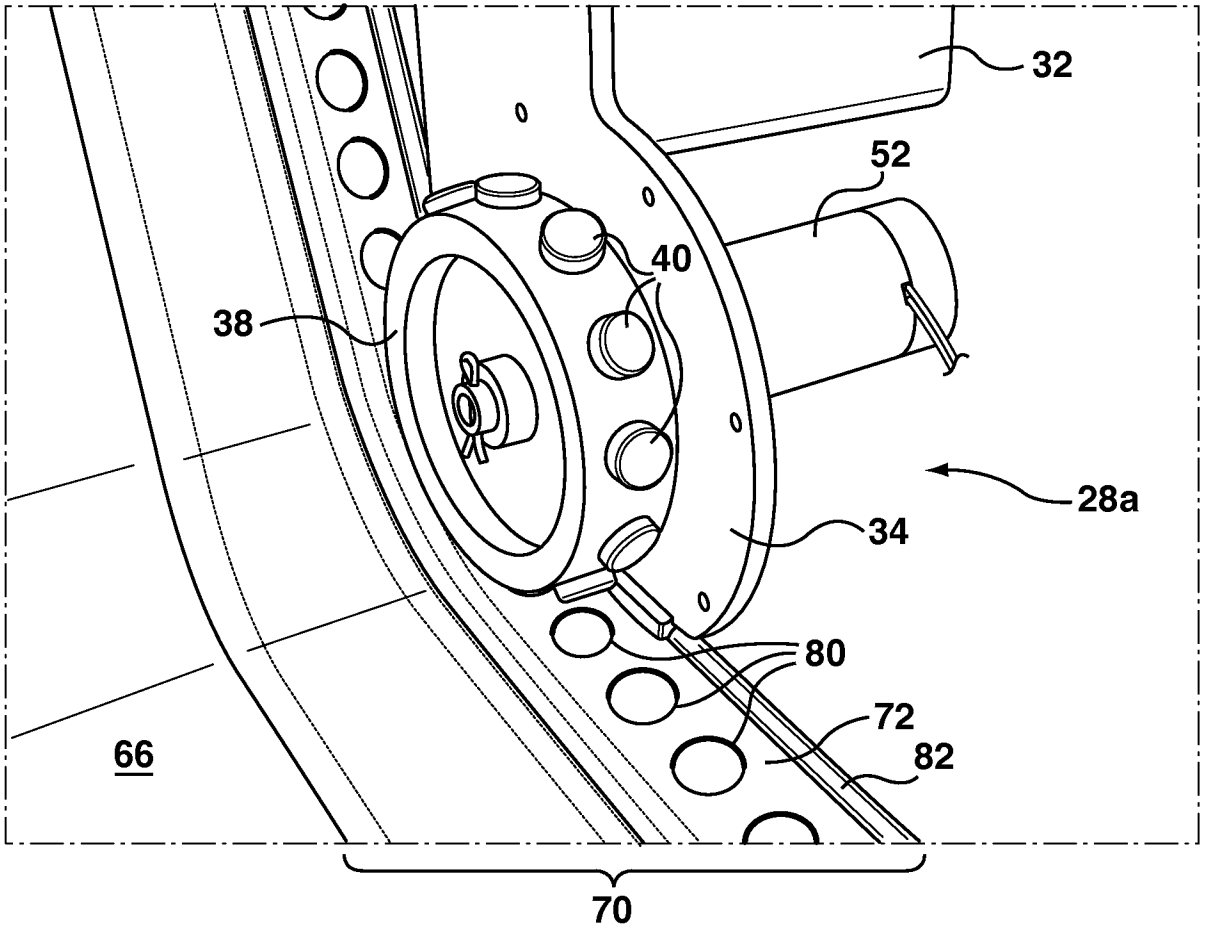

Referring now to FIGS. 7 and 8, the drive mechanism 28*a* engages the edge portion 70 and moves the cover assembly 26 relative to the frame 22*a* to advance or retract the cover assembly 26. In FIG. 8, the wheel guard 56 has been removed to provide a view of the arrangement of the feed wheel 38 relative to the edge portion 70. At least one of the engagement elements 40 interengages with respective at least one of the engagement elements 80, and rotation of the feed wheel 38 causes the cover assembly 26 to move relative to the frame 22*a*. In some examples, as illustrated, the engagement elements 40 may be protrusions having a generally cylindrical shape, and the engagement elements 80 may be apertures having a generally circular shape. Furthermore, as illustrated, each of the engagement elements 40 may include a rounded outer rim, which may help the engagement elements 40 locate the engagement elements 80.

The drive mechanism 28*a* may guide the lip 82 of the edge portion 70 so that the cover assembly 26 is presented in a generally horizontal position when advanced out of the drive mechanism 28*a*. The drive mechanism 28*a* may restrict lateral movement of the lip 82 of the edge portion 70. In some examples, the guide blocks 60*a*, 60*b* and guide rails 62*a*, 62*b* may slidingly receive the lip 82 of the edge portion 70, and securely guide the edge portion 70 as the cover assembly 26 is advanced or retracted.

Dimensions of the lip 82 and material selection of the strip 72 may be chosen so that the strip 72 is flexible enough to be wound about the spool 24 (FIG. 1) once retracted, while at the same time possessing stiffness and rigidity so as to transmit sufficient outward force in the longitudinal direction to advance the cover assembly 26 out of the drive mechanism 28*a*. Referring again to FIG. 6, the diameter dimension 84 of the lip 82 may be about, for example but not limited to, 0.125" to 0.5", whereas the thickness dimension 86 of the strip 72 may be about, for example but not limited to, 0.03125" to 0.125". In some examples, the strip 72 may be formed of high-density polyethylene (HDPE), medium-density polyethylene (MDPE) or low-density polyethylene (LDPE). Dimensions of the lip 82 may be varied, depending on the material, to adjust the stiffness characteristics.

Referring again to FIG. 7, the drive mechanism 28*a* may include a sensor 88 for monitoring a position of the cover assembly 26 relative to the drive mechanism 28*a*. In some examples, the sensor 88 may be configured to monitor the position of the cover assembly 26 to identify when fully advanced and fully retracted positions are reached. The inventors have had satisfactory results using a MP2018 Series magnetic reed sensor (ZF Electronics Corporation, Pleasant Prairie, Wis.) as the sensor 88.

Figure 9:
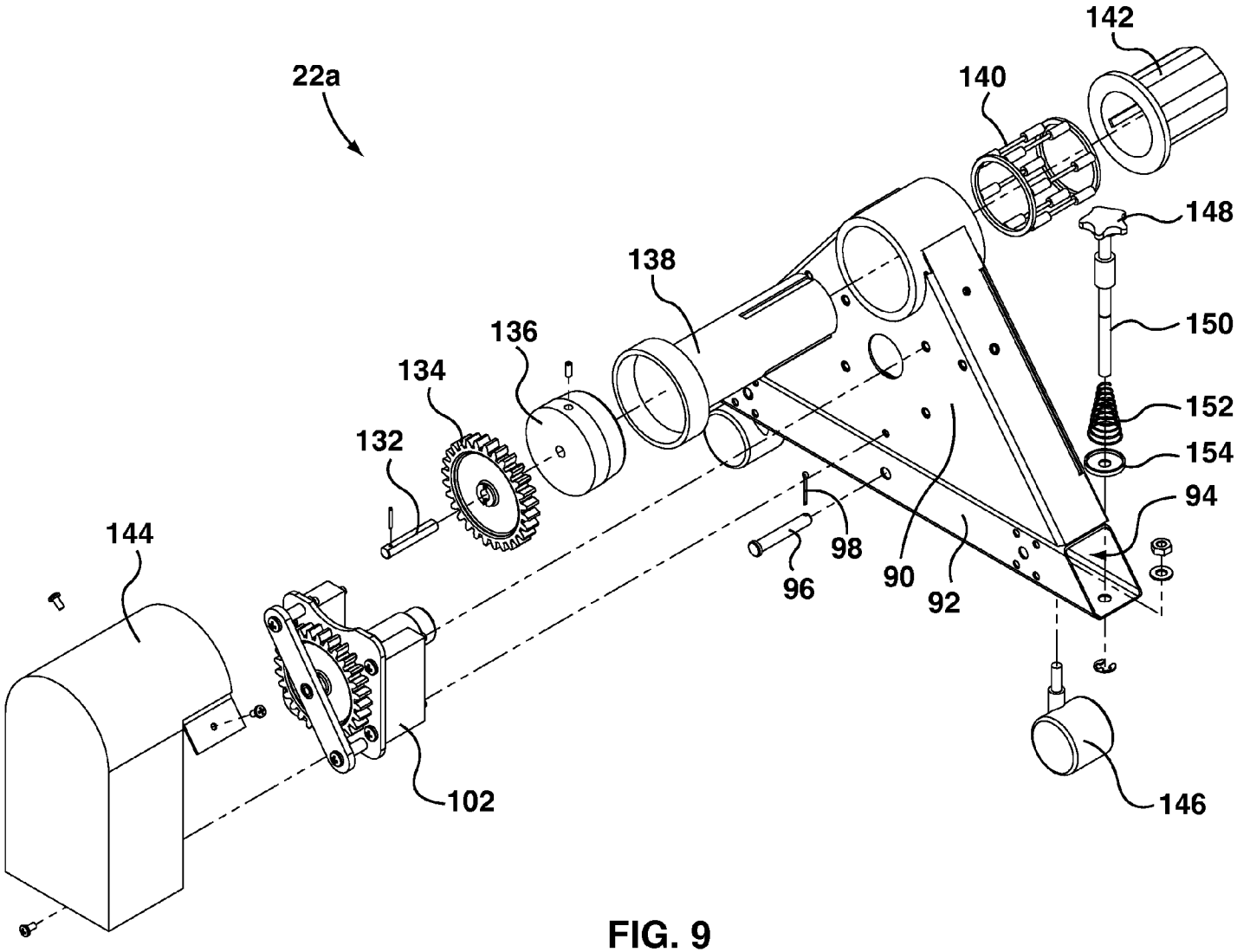
FIGS. 9 and 10 are perspective views of a frame of the cover apparatus of FIGS. 1 and 2, shown in exploded and assembled states, respectively.
Figure 10:
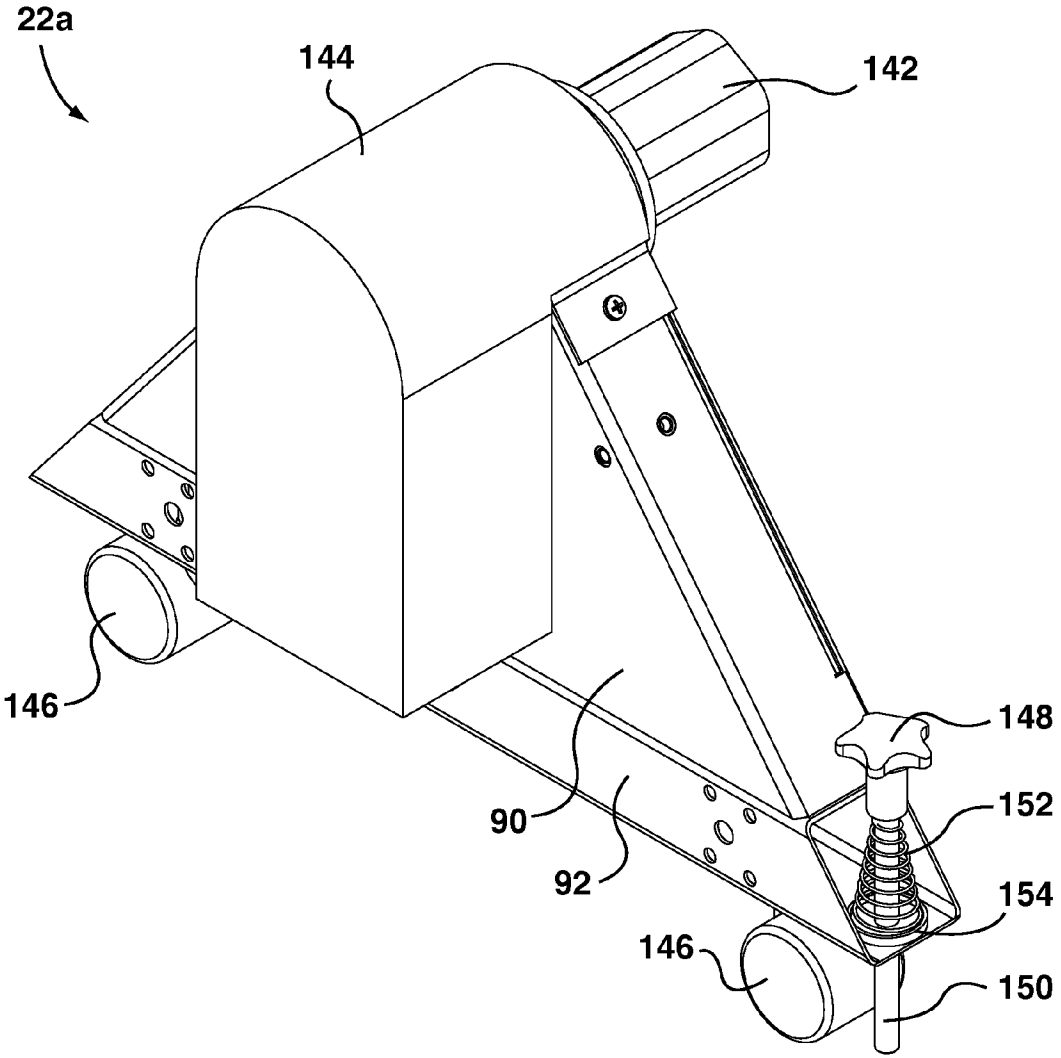

Referring to FIGS. 9 and 10, the frame 22*a* is shown to include an upright base 90 and a lower tubular portion 92 secured to the base 90. In the example illustrated, the tubular portion 92 defines a channel 94 that is sized and shaped to slidingly receive the arm 30 of the drive mechanism 28*a* (FIG. 3). A clevis pin 96 and a cotter pin 98 may engage holes 100 (FIG. 3) of the arm 30 to adjustably lock the drive mechanism 28*a* into position relative to the frame 22*a*. In some examples, where the drive mechanism 28*a* is adjustably positionable relative to the spool 24 (FIG. 1), the cover apparatus may be compatible with pool designs having different corner radiuses.

Figure 11:
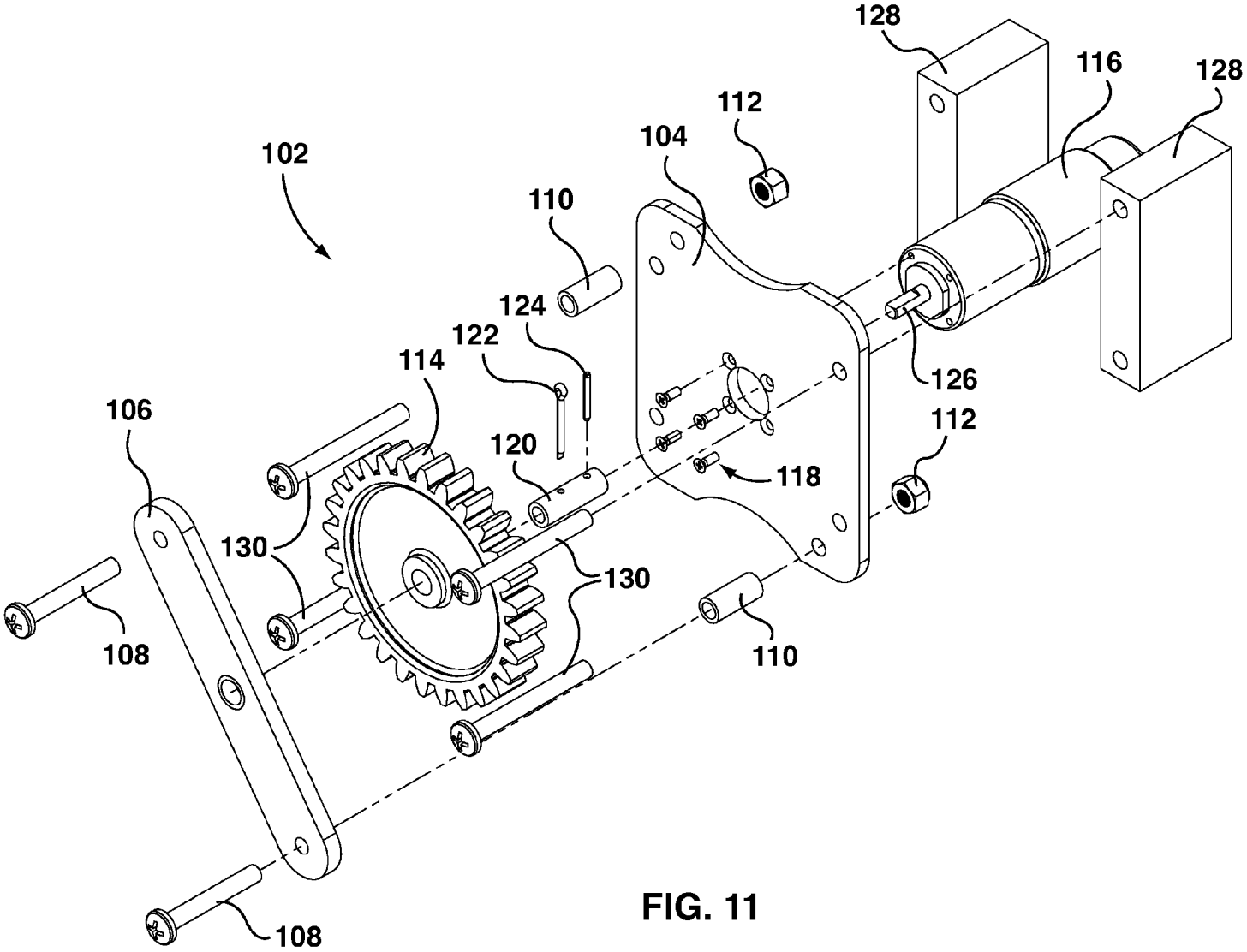
FIG. 11 is an exploded perspective view of an arbor assembly of the frame of FIGS. 9 and 10.

The frame 22*a* may include an arbor apparatus 102, which is shown in greater detail in FIG. 11. In the example illustrated, the arbor apparatus 102 includes a support plate 104 and a support arm 106 secured to the support plate 104 with bolts 108, spacer tubes 110 and nuts 112. A drive gear 114 is sandwiched between the support plate 104 and the support arm 106. A second motor 116 is secured to the support plate 104 by fasteners 118. The inventors have had satisfactory results using a PK32F Series DC planetary gear motor (Hennkwell Ind. Co., Ltd., Taiwan, R.O.C.) as the second motor 116. A sleeve 120, a cotter pin 122 and a spring pin 124 couple the second motor 116 and the drive gear 114 to transmit rotational power from a shaft 126 of the second motor 116 to the drive gear 114. Other coupling elements may be arranged between the shaft 126 and the drive gear 114, to extend the dimension therebetween. The arbor apparatus 102 further includes spacer blocks 128 that, along with the support plate 104, are secured to the base 90 of the frame 22*a* (FIG. 9) by fasteners 130.

In some examples, a clutch mechanism (not shown) may be coupled with the drive gear 114. The clutch mechanism may be configured to switch between engaged and disengaged modes, for example, if torque conditions on the motor 116 exceed a predetermined level. In this manner, the clutch mechanism may be used as a fail-safe to mechanically disconnect the motor 116 in the event of a jam. A similar clutch mechanism may be provided for the feed wheel 38.

Referring again to FIGS. 9 and 10, the frame 22*a* is shown to include a shaft 132, a drive gear 134, an adapter 136, a spool drive 138, a roller bearing 140, and a spool plug 142. In some examples, the drive gear 134, the adapter 136 and the spool drive 138 may be arranged as a one-piece component, and may include a central passage (not shown) for supplying electrical power to the second motor 116 of the arbor apparatus 102. The spool plug 142 is received in an end of the spool 24 (FIG. 1). The drive gear 134 and the drive gear 114 mesh to transmit rotational power from the second motor 116 to the spool plug 142, thereby to drive rotation of the spool 24. By driving the spool 24 in addition to the drive mechanism 28*a*, the second motor 116 may help to reduce load on the first motor 36, and furthermore may help to reduce force that is transmitted by interengagement of the engagement elements 40, 80.

The frame 22*a* is shown to further include a cover 144 to generally enclose the arbor apparatus 102, the drive gear 134, and other components. In use, the cover apparatus 20 may be generally stationary. Nevertheless, it may be desirable for the frame 22*a* to include casters 146 to permit the user to rollably position the cover apparatus 20 adjacent to the pool. The frame 22*a* may include a hand screw 148 coupled to a spacer leg 150, a spring 152 and a washer 154. Using the hand screw 148, the user may extend the spacer leg 150 to engage the ground and prevent the frame 22*a* from rolling on the casters 146.

Figure 12:
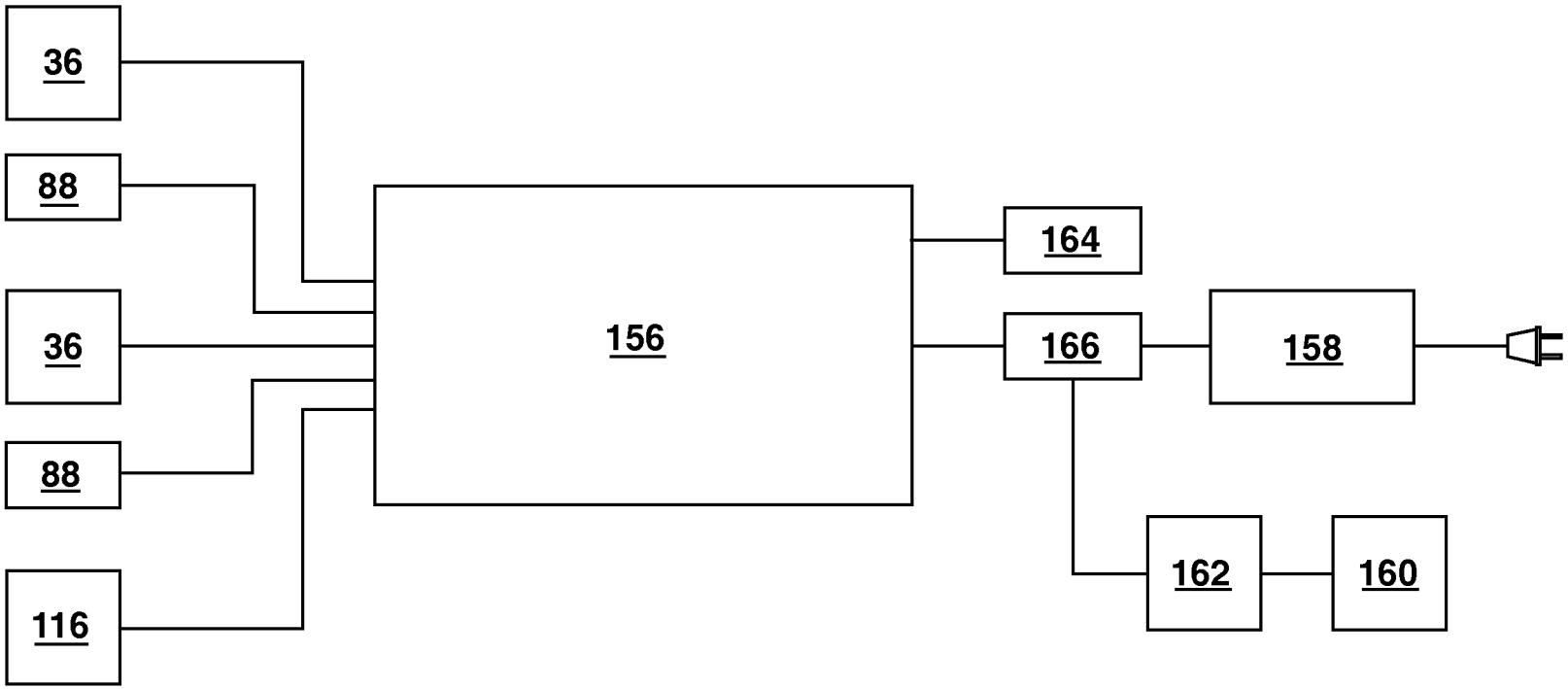
FIG. 12 is a schematic electrical diagram of the cover apparatus of FIGS. 1 and 2.

Referring to FIG. 12, a control device 156 may be used to electrically control operation of the first motors 36 and the second motor 116. In various examples, the control device 156 may be implemented on a programmable processing device, such as a microprocessor or microcontroller, Central Processing Unit (CPU), Digital Signal Processor (DSP), Field Programmable Gate Array (FPGA), application-specific integrated circuit (ASIC), and the like. In some examples, the control device 156 may be housed in a 1555NF17GY enclosure (Hammond Manufacturing Company Inc., Cheektowaga, N.Y.).

Referring again to FIG. 1, in some examples, each of the drive mechanisms 28*a*, 28*b* may include one of the first motor 36, whereas only one of the frames 22*a*, 22*b* may be arranged with the second motor 116 to drive the spool 24. For this reason, FIG. 12 shows two of the first motors 36, and one of the second motor 116.

With reference to FIGS. 1 and 12, the control device 156, by controlling the motors 36, 116, may be configured to generally synchronize movement of the feed wheel 38 (FIG. 3) and the spool 24. However, the rate in which the cover assembly 26 is delivered to the drive mechanisms 28*a*, 28*b* by the frames 22*a*, 22*b* may be in proportion to how much of the cover assembly 26 is wound about the spool 24. For this reason, in some examples, the control device 156 may be configured to gear the first motors 36, the second motor 116, or both, in a proportional manner so that a generally consistent speed of advancing/retracting the cover assembly 26 is achieved. In some examples, the control device 156 may take into consideration the position of the cover assembly (e.g., as detected by the sensors 88), and electronically gear the second motor 116 to maintain a generally consistent rate in which the cover assembly 26 is delivered to the drive mechanisms 28*a*, 28*b* by the frames 22*a*, 22*b*.

The control device 156 may deliver power to the motors 36, 116 from different sources. In various examples, the control device 156 may be connected to a grid power supply 158, a solar panel 160 and a battery 162. As illustrated, the solar panel 160 and the battery 162 may be linked so that power from the solar panel 160 is stored in the battery 162. For example, an LXV75-024SW AC/DC power supply (Excelsys Technologies, Cork, Ireland) may be implemented as the grid power supply 158.

A user input 164 may be provided to control movement of the cover assembly, and a master switch 166 may be provided to cut off power to the control device 156. For example, a GCX1102 pushbutton (Automationdirect.com, Cumming, Ga.) may be implemented as the user input 164, and a 84828-07 key switch (Honeywell International, Morristown, N.J.) may be implemented as the master switch 166. In some examples, in use, when input to the user input 164 is given (e.g., depressed) a first time, the cover assembly 26 is unwound from the spool 24. When the user input 164 is depressed a second time, it stops the cover assembly 26 from unwinding. When depressed a third time, the cover assembly 26 may be wound onto the spool 24, and when depressed a fourth time it stops the cover assembly 26 from winding. When depressed a fifth time, the sequence begins again and the cover assembly 26 is unwound from the spool 24. In this manner, the user input 164 may control operation of the cover apparatus 20 similar to that of an electric overhead garage door opener.

While the above description provides examples of one or more apparatuses or methods, it will be appreciated that other apparatuses or methods may be within the scope of the accompanying claims.

We claim:

1. A cover apparatus for covering a pool, comprising:

a frame;

a cover assembly at least partially supported by the frame, the cover assembly comprising a generally planar main portion having at least one side edge, and at least one edge portion adjoining the at least one side edge of the main portion; and a drive mechanism coupled to the frame, the drive mechanism configured to engage the at least one edge portion and move the cover assembly relative to the frame for advancing or retracting the cover assembly to cover or uncover the pool, respectively, wherein the drive mechanism comprises first engagement elements, and the edge portion comprises second engagement elements that interengage with the first engagement elements, wherein the first engagement elements comprise protrusions, and the second engagement elements comprise apertures that are sized and shaped to receive the protrusions, wherein the edge portion comprises an integral strip attached along the at least one side edge of the main portion, and the strip comprises the apertures and an enlarged outer lip that is adjacent to the apertures and extends continuously along a longitudinal extent of the edge portion, and wherein the drive mechanism further comprises at least one guide element, the at least one guide element for slidingly receiving the outer lip of the edge portion, so that the outer lip is guided by the drive mechanism when the cover assembly is advanced out of the drive mechanism.

2. The apparatus of claim 1, wherein the drive mechanism comprises a feed wheel, and rotation of the feed wheel causes the cover assembly to move relative to the frame.

3. The apparatus of claim 2, wherein the protrusions are spaced apart about an outer circumference of the feed wheel, and the apertures are complementarily spaced apart along the longitudinal extent of the edge portion.

4. The apparatus of claim 3, wherein the protrusions are generally cylindrical in shape, and the apertures are generally circular in shape.

5. The apparatus of claim 2, further comprising a spool that is rotatably supported by the frame, and the cover assembly is wound and unwound about the spool when retracted or advanced by the drive mechanism, respectively.

6. The apparatus of claim 5, wherein the drive mechanism comprises a first motor for rotating the feed wheel, the frame comprises a second motor for rotating the spool, the second motor being operable separately from the first motor.

7. The apparatus of claim 6, further comprising a control device connected to the first and second motors, and configured to generally synchronize movement of the feed wheel and the spool so that a rate in which the cover assembly is delivered to the drive mechanism is in proportion to how much of the cover assembly is wound about the spool.

8. The apparatus of claim 7, wherein the spool is controlled so as to maintain a generally consistent rate that the cover assembly is delivered to the drive mechanism.

9. The apparatus of claim 7, further comprising at least one sensor for monitoring a position of the cover assembly relative to the drive mechanism.

10. The apparatus of claim 5, wherein the drive mechanism is adjustably positionable relative to the spool.

11. The apparatus of claim 10, wherein the frame comprises a channel, and the drive mechanism comprises an arm that is slidingly received in the channel.

12. The apparatus of claim 5, wherein, when the cover assembly is unwound about the spool and advanced by the drive mechanism, the cover assembly is conveyed downwardly at an angle between the spool and the at least one guide element.

13. The apparatus of claim 12, wherein, when the cover assembly is unwound about the spool and advanced by the drive mechanism, the at least one guide element transmits the outer lip of the edge portion along a generally arcuate path so that the cover assembly is presented in a generally horizontal position to cover the pool.

14. The apparatus of claim 1, wherein the at least one guide element of the drive mechanism guides the outer lip of the edge portion so that the cover assembly is presented in a generally horizontal position when advanced out of the drive mechanism.

15. The apparatus of claim 14, wherein the at least one guide element of the drive mechanism restricts lateral movement of the outer lip of the edge portion.

16. The apparatus of claim 15, wherein the at least one guide element of the drive mechanism comprises at least one of:

at least one guide block arranged to slidingly receive the outer lip of the edge portion; and a pair of generally opposing guide rails arranged to slidingly receive the outer lip of the edge portion.

17. The apparatus of claim 7, wherein the frame comprises left and right frames spaced apart on generally opposing sides of the cover assembly.

18. The apparatus of claim 7, wherein the drive mechanism comprises left and right drive mechanism spaced apart on generally opposing sides of the cover assembly.

19. The apparatus of claim 1, wherein the outer lip has a generally circular cross section and a diameter dimension that is at least four times a thickness dimension of the strip.

20. The apparatus of claim 1, wherein the outer lip has a generally circular cross section with a diameter dimension between 0.125" to 0.5", and a thickness dimension of the strip is between 0.03125" to 0.125".

21. The apparatus of claim 20, wherein the strip is formed of a material selected from the group consisting of high-density polyethylene, medium-density polyethylene and low-density polyethylene.

22. A cover apparatus for covering a pool, comprising:

a frame;

a cover assembly at least partially supported by the frame, the cover assembly comprising a generally planar main portion having a side edge, and an edge portion adjoining the side edge of the main portion, the edge portion comprising an integral strip extending along a length of the edge portion, the strip comprising a plurality of apertures spaced apart along the length of the edge portion, and an enlarged outer lip having a generally circular cross section and extending continuously along the length of the edge portion adjacent to the plurality of apertures; and a drive mechanism coupled to the frame, the drive mechanism comprising a feed wheel comprising a plurality of protrusions spaced apart about an outer circumference of the feed wheel, and at least one guide element adjacent to the feed wheel, wherein the apertures receive the protrusions, so that the feed wheel engages the edge portion, and rotation of the feed wheel causes the cover assembly to move relative to the frame for advancing or retracting the cover assembly to cover or uncover the pool, respectively, and wherein the at least one guide element slidingly receives the outer lip of the edge portion, so that lateral movement of the outer lip is restricted, and the outer lip is guided by the drive mechanism when the cover assembly is advanced out of the drive mechanism so that the cover assembly is presented in a generally horizontal position to cover the pool.

23. A cover apparatus for covering a pool, comprising:

a frame;

a cover assembly at least partially supported by the frame, the cover assembly comprising a generally planar main portion having first and second side edges, and respective first and second edge portions adjoining the first and second side edges of the main portion, the first and second edge portions comprising first and second integral strips extending along a respective longitudinal extent thereof, each of the first and second strips comprising first engagement elements spaced apart along the respective longitudinal extent, and an enlarged outer lip extending continuously along the respective longitudinal extent adjacent to the respective first engagement elements, each of the first engagement elements being selected from one of protrusions and apertures that are sized and shaped to receive the protrusions; and first and second drive mechanisms coupled to the frame, the first and second drive mechanisms configured to respectively engage the first and second edge portions and move the cover assembly relative to the frame for advancing or retracting the cover assembly to cover or uncover the pool, respectively, each of the first and second drive mechanisms comprising a feed wheel, and second engagement elements spaced apart about an outer circumference of the feed wheel, each of the second engagement elements being selected from the other of the protrusions and the apertures, the second engagement elements interengaging with the first engagement elements so that rotation of the feed wheel causes the cover assembly to move relative to the frame, each of the first and second drive mechanisms further comprising at least one guide element adjacent to the respective feed wheel for slidingly receiving the outer lip of the respective edge portion, so that lateral movement of the outer lips are restricted, and the outer lips are guided by the first and second drive mechanisms when the cover assembly is advanced out of the first and second drive mechanisms so that the cover assembly is presented in a generally horizontal position to cover the pool.

* * * * *